US011629027B2

(12) United States Patent
Isogai

(10) Patent No.: US 11,629,027 B2
(45) Date of Patent: Apr. 18, 2023

(54) SHEET CONVEYING DEVICE, IMAGE PROCESSING APPARATUS, AND SHEET CONVEYING METHOD

(71) Applicant: KYOCERA Document Solutions Inc., Osaka (JP)

(72) Inventor: Yoji Isogai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/654,374

(22) Filed: Mar. 10, 2022

(65) Prior Publication Data

US 2022/0315374 A1 Oct. 6, 2022

(30) Foreign Application Priority Data

Mar. 31, 2021 (JP) ..... JP2021-059513

(51) Int. Cl.
*B65H 31/10* (2006.01)

(52) U.S. Cl.
CPC ..... *B65H 31/10* (2013.01); *B65H 2405/353* (2013.01)

(58) Field of Classification Search
CPC ..... G03G 15/6552; H04N 1/00604; H04N 1/00631; B65H 7/02; B65H 7/14; B65H 1/18; B65H 31/10; B65H 31/26; B65H 2405/353
USPC ..... 271/162, 213
See application file for complete search history.

(56) References Cited

U.S. PATENT DOCUMENTS 10,800,630 B2 * 10/2020 Fujiwara ..... B65H 29/14
10,961,074 B2 * 3/2021 Miwa ..... B65H 29/50
11,312,588 B2 * 4/2022 Heineck ..... B65H 29/52
(Continued)

FOREIGN PATENT DOCUMENTS

JP 2002338119 A 11/2002
JP 2005008283 A * 1/2005
(Continued)

OTHER PUBLICATIONS

Espacenet machine translation of JP2005015122A; http://translationportal.epo.org/emtp/translate/?ACTION=description-retrieval&COUNTRY=JP&ENGINE=google&FORMAT=docdb&KIND=A&LOCALE=en_EP&NUMBER=2005015122&OPS=ops.epo.org/3.2&SRCLANG=ja&TRGLANG=en (Year: 2005).*
(Continued)

*Primary Examiner* — Leslie A Nicholson, III
(74) *Attorney, Agent, or Firm* — Alleman Hall Creasman & Tuttle LLP

(57) ABSTRACT

A sheet conveying device includes a sheet placement table, a sheet discharge table, a conveyance mechanism, raising/lowering mechanism, and a raising/lowering control portion. The sheet discharge table is located below the sheet placement table. The conveyance mechanism conveys a sheet placed on the sheet placement table onto the sheet discharge table via an execution position at which image processing is executed by an image processing portion. The raising/lowering mechanism raises and lowers the sheet placement table. The raising/lowering control portion controls the raising/lowering mechanism in accordance with a clearance that is defined by a height from the sheet on the sheet discharge table to the sheet placement table, so as to maintain the clearance to be equal to or higher than a set value.

7 Claims, 7 Drawing Sheets

(56) References Cited

U.S. PATENT DOCUMENTS

2020/0223650 A1* 7/2020 Heineck ..... B65H 1/04

FOREIGN PATENT DOCUMENTS

JP 2005015122 A * 1/2005
WO WO-2019070286 A1 * 4/2019 ..... B65H 1/04

OTHER PUBLICATIONS

Espacenet machine translation of JP2005008283A; http://translationportal.epo.org/emtp/translate/?ACTION=description-retrieval&COUNTRY=JP&ENGINE=google&FORMAT=docdb&KIND=A&LOCALE=en_EP&NUMBER=2005008283&OPS=ops.epo.org/3.2&SRCLANG=ja&TRGLANG=en (Year: 2005).*

* cited by examiner

SHEET CONVEYING DEVICE, IMAGE PROCESSING APPARATUS, AND SHEET CONVEYING METHOD

INCORPORATION BY REFERENCE

This application is based upon and claims the benefit of priority from the corresponding Japanese Patent Application No. 2021-059513 filed on Mar. 31, 2021, the entire contents of which are incorporated herein by reference.

BACKGROUND

The present disclosure relates to a sheet conveying device, an image processing apparatus, and a sheet conveying method.

There is known, as a related technology, a sheet conveying device (document sheet conveying device) that includes a sheet placement table (sheet feed tray) and a sheet discharge table (sheet discharge tray), wherein sheets (document sheets) are placed on the sheet placement table, and a sheet on which image processing (image reading) has been performed is discharged onto the sheet discharge table. The sheet conveying device of the related technology includes a conveyance mechanism that feeds sheets placed on the sheet placement table one by one to a reading position, and discharges a sheet after image processing (image reading) selectively onto one of two sheet discharge tables (a first sheet discharge tray or a second sheet discharge tray). In this sheet conveying device, the sheet placement table is located above the sheet discharge table. As a result, a sheet as a target of the image processing is moved from an upper side of the sheet placement table to a lower side thereof (between the sheet placement table and the sheet discharge table).

SUMMARY

A sheet conveying device according to an aspect of the present disclosure includes a sheet placement table, a sheet discharge table, a conveyance mechanism, raising/lowering mechanism, and a raising/lowering control portion. The sheet discharge table is located below the sheet placement table. The conveyance mechanism conveys a sheet placed on the sheet placement table onto the sheet discharge table via an execution position at which image processing is executed by an image processing portion. The raising/lowering mechanism raises and lowers the sheet placement table. The raising/lowering control portion controls the raising/lowering mechanism in accordance with a clearance that is defined by a height from the sheet on the sheet discharge table to the sheet placement table, so as to maintain the clearance to be equal to or higher than a set value.

An image processing apparatus according to another aspect of the present disclosure includes the sheet conveying device and the image processing portion. The image processing portion executes at least one of image reading and image forming on the sheet as a target.

A sheet conveying method according to a further aspect of the present disclosure is used in a sheet conveying device that includes a sheet placement table, a sheet discharge table, a conveyance mechanism, raising/lowering mechanism, and a raising/lowering control portion. The sheet discharge table is located below the sheet placement table. The conveyance mechanism conveys a sheet placed on the sheet placement table onto the sheet discharge table via an execution position at which image processing is executed by an image processing portion. The raising/lowering mechanism raises and lowers the sheet placement table. The sheet conveying method includes controlling the raising/lowering mechanism in accordance with a clearance that is defined by a height from the sheet on the sheet discharge table to the sheet placement table, so as to maintain the clearance to be equal to or higher than a set value.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

Embodiment 1

[1] Entire Configuration of Image Processing Apparatus

Figure 1:
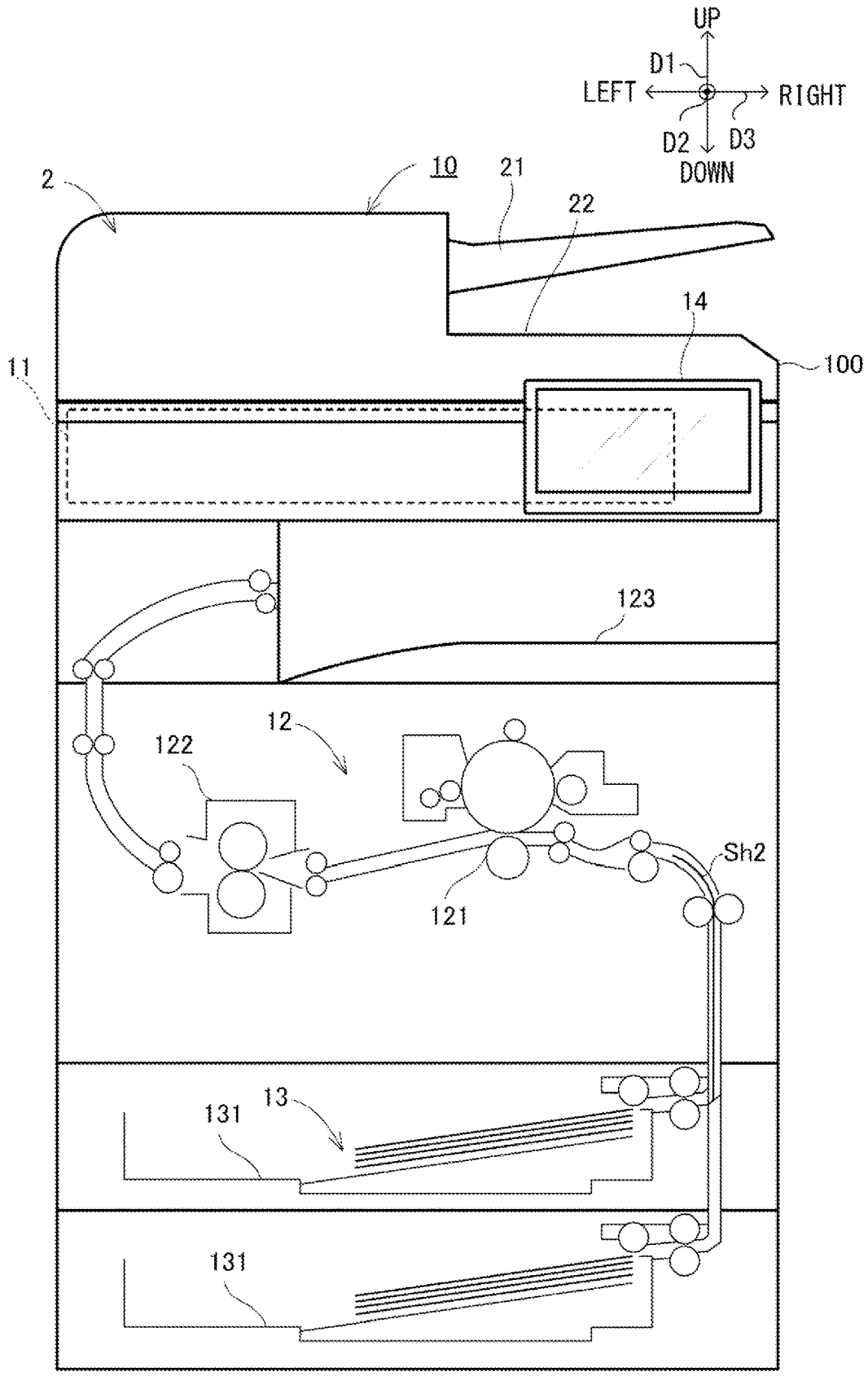
FIG. 1 is a schematic diagram showing an external appearance and an internal configuration of an image processing apparatus according to Embodiment 1.
Figure 2:
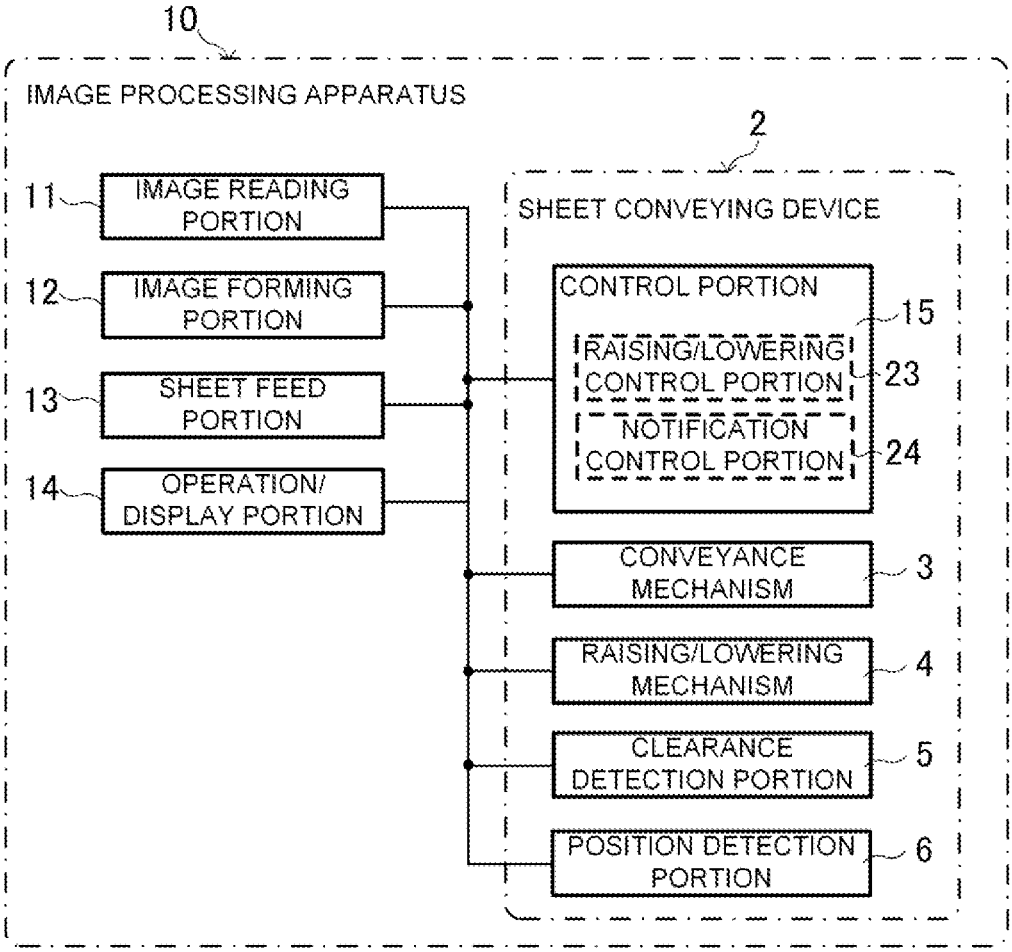
FIG. 2 is a schematic block diagram of the image processing apparatus according to Embodiment 1.

First, the following describes an entire configuration of an image processing apparatus 10 according to the present embodiment with reference to FIG. 1 and FIG. 2.

For the sake of explanation, a vertical direction in a state where the image processing apparatus 10 is usably installed (the state shown in FIG. 1), is defined as an up-down direction D1. In addition, a direction of the image processing apparatus 10 shown in FIG. 1 perpendicular to the paper surface is defined as a front-back direction D2, and a surface located on the front side in FIG. 1 is defined as a front surface. Furthermore, a left-right direction D3 is defined on the supposition that a surface on the left side in FIG. 1 is a left surface.

The image processing apparatus 10 according to the present embodiment is, for example, a multifunction peripheral having a plurality of functions such as a scan function to acquire an image (image data) from a document sheet, a print function to form an image based on image data, a facsimile function, and a copy function. The image processing apparatus 10 only needs to include an image processing function that includes at least one of a function to form an image and a function to read an image, and may be a printer, a scanner, a facsimile apparatus, or a copier.

As shown in FIG. 2, the image processing apparatus 10 includes a sheet conveying device 2, an image reading portion 11, an image forming portion 12, a sheet feed portion 13, an operation/display portion 14, and a control portion 15. In the present embodiment, as shown in FIG. 1, the image processing apparatus 10 includes a housing 100. The sheet conveying device 2, the image reading portion 11, the image forming portion 12, the sheet feed portion 13, the operation/display portion 14, and the control portion 15 are provided in the housing 100.

In the present embodiment, the sheet conveying device 2 is an auto document feeder (ADF). The sheet conveying device 2 conveys a sheet Sh1 (document sheet) as a reading target (image processing target) from which an image is read by the image reading portion 11. The sheet conveying device 2 includes a sheet placement table 21, a sheet discharge table 22, a conveyance mechanism 3, a raising/lowering mechanism 4, a clearance detection portion 5, and a position detection portion 6. The sheet conveying device 2 drives the conveyance mechanism 3 so that a sheet Sh1 set on the sheet placement table 21 is conveyed to the sheet discharge table 22 by passing an image reading position at which the image reading portion 11 reads an image from the sheet Sh1.

The image reading portion 11 reads an image from the sheet Sh1 (document sheet) and outputs image data corresponding to the read image. The image reading portion 11 includes a document sheet table, a light source, a plurality of mirrors, an optical lens, and a CCD (Charge Coupled Device).

The image forming portion 12 forms an image on a sheet Sh2 based on the image data output from the image reading portion 11. In addition, the image forming portion 12 forms an image on a sheet Sh2 based on image data input from an information processing apparatus, such as a personal computer, that is external to the image processing apparatus 10. In the present embodiment, as one example, as shown in FIG. 1, the image forming portion 12 includes a transfer device 121, a fixing device 122, and a sheet discharge tray 123, and forms an image on the sheet Sh2 by an electrophotographic method. Not limited to a configuration to form a monochrome image, the image forming portion 12 may have a configuration to form a full-color image by using four colors: C (cyan), M (magenta), Y (yellow), and K (black). In addition, the image forming portion 12 may have a configuration to form an image on a sheet by an image forming method, such as an ink jet method, other than the electrophotographic method.

The image forming portion 12 forms an image on a sheet Sh2 by using toner as developer. Specifically, the image forming portion 12 irradiates a laser light on an electrically charged surface of a photoconductor drum to form an electrostatic latent image thereon, and forms a toner image on the surface of the photoconductor drum by developing the electrostatic latent image by the toner. The transfer device 121 transfers the toner image to a sheet Sh2 while it is conveyed along a conveyance path. The fixing device 122 fixes the toner image that has been transferred to a sheet Sh2, to the sheet Sh2 by melting. For example, the fixing device 122 includes a fixing roller and a pressing roller, and fixes the toner image to the sheet Sh2 by heating the toner image that has been transferred to the sheet Sh2, while applying pressure to the sheet Sh2. The sheet Sh2 with the image formed thereon is discharged to the sheet discharge tray 123. In a case where the image forming portion 12 forms an image by the ink jet method, ink (another example of the developer) is supplied instead of the toner.

The sheet feed portion 13 supplies a sheet Sh2 to the image forming portion 12. The sheet feed portion 13 includes a plurality of sheet feed cassettes 131, a manual feed tray, and a plurality of conveyance rollers. The sheet feed portion 13 feeds a sheet Sh2 from the plurality of sheet feed cassettes 131 or the manual feed tray, and the sheet Sh2 is conveyed along a conveyance path by the plurality of conveyance rollers to be supplied to the image forming portion 12. The image forming portion 12 forms an image on the sheet Sh2 supplied from the sheet feed portion 13 along the conveyance path.

The operation/display portion 14 is a user interface in the image processing apparatus 10. The operation/display portion 14 includes a display portion and an operation portion, wherein the display portion is, for example, a liquid crystal display that displays various types of information in accordance with a control instruction from the control portion 15, and the operation portion is, for example, a switch or a touch panel that inputs various types of information to the control portion 15 in accordance with a user operation. In addition, the image processing apparatus 10 may include, as user interfaces, an audio output portion and an audio input portion for example in addition to or in place of the operation/display portion 14. In addition, the operation/display portion 14 may be, for example, an external device that is provided independently of the housing 100. In this case, the image processing apparatus 10 can use the operation/display portion 14 as a user interface by performing a data communication with the external device.

The control portion 15 comprehensively controls the image processing apparatus 10. A main configuration of the control portion 15 is a computer system that includes one or more processors and one or more memories. In the image processing apparatus 10, the functions of the control portion 15 are realized when the one or more processors execute programs. The programs may be preliminarily recorded on the one or more memories, may be provided via an electric communication line such as the Internet, or maybe provided in a state of being recorded on a non-transitory recording medium, such as a memory card or an optical disc, that can be read by a computer system. The one or more processors are composed of one or more electronic circuits including a semiconductor integrated circuit. Furthermore, the computer system referred to in the present disclosure includes a micro controller that includes one or more processors and one or more memories. The control portion 15 may be a control portion that is provided independently of a main control portion that comprehensively controls the image processing apparatus 10.

In addition, the image processing apparatus 10 further includes a storage portion, a communication portion, and a power source portion. The storage portion includes one or more nonvolatile memories, and preliminarily stores information, such as control programs, for causing the control portion 15 to execute various types of processing. The communication portion is an interface configured to execute a data communication between the image processing apparatus 10 and, for example, an external apparatus that is connected therewith via a communication network such as the Internet or a LAN (Local Area Network). The power source portion is a power source circuit configured to generate (output) an electric power for operating the image processing apparatus 10.

Here, the sheet conveying device 2 of the present embodiment constitutes the image processing apparatus 10 together with an image processing portion (the image reading portion 11 and the image forming portion 12). In other words, the sheet conveying device 2 of the present embodiment includes the sheet conveying device 2 and an image processing portion that executes at least one of image reading and image forming on the sheet Sh1 as a target.

[2] Sheet Conveying Device

Next, the following describes a configuration of the sheet conveying device 2 according to the present embodiment in more detail with reference to FIG. 2 to FIG. 6.

The sheet conveying device 2 is configured to convey a sheet Sh1 from the sheet placement table 21 to the sheet discharge table 22. Here, the "sheet" of the present disclosure is a target of image reading or a target of image forming. As one example, in the present embodiment, a sheet Sh1 as a target of conveyance by the sheet conveying device 2 is a sheet Sh1 (document sheet) as a target of image reading by the image reading portion 11. That is, in the present embodiment, the sheet conveying device 2 conveys a sheet Sh1 placed on the sheet placement table 21 onto the sheet discharge table 22 via an execution position P1 (see FIG. 3) at which image processing (image reading) is executed by the image reading portion 11 as an image processing portion. Accordingly, the position at which the image is read by the image reading portion 11 corresponds to the execution position P1. In addition, in the present embodiment, the sheet Sh1 is paper as one example. However, the sheet Sh1 is not limited to paper, but may be, for example, a resin film.

In the present embodiment, in addition to the sheet placement table 21, the sheet discharge table 22, the conveyance mechanism 3, the raising/lowering mechanism 4, the clearance detection portion 5, and the position detection portion 6, the sheet conveying device 2 includes a raising/lowering control portion 23 and a notification control portion 24. The raising/lowering control portion 23 and the notification control portion 24 are provided in the control portion 15 as functions of the control portion 15. That is, in the present embodiment, the image processing apparatus 10 is provided with the raising/lowering control portion 23 and the notification control portion 24 included in the sheet conveying device 2, as functions of the control portion 15.

The sheet placement table 21 is a member on which a sheet Sh1 as a target of conveyance by the sheet conveying device 2 is placed. In the present embodiment, a sheet Sh1 conveyed by the sheet conveying device 2 is a sheet Sh1 (document sheet) as a target of image reading by the image reading portion 11. As a result, a sheet Sh1 set on an upper surface of the sheet placement table 21 is a sheet Sh1 before image reading by the image reading portion 11.

Here, sheets Sh1 of various sizes (paper sizes), such as A3E (A3 lateral size), B4E (B4 lateral size), 2 L print size, L print size, postcard, or business card, can be set on the sheet placement table 21. The sheet placement table 21 includes a pair of cursors that face each other in the front-back direction D2, and the distance between the pair of cursors is adjusted in accordance with a size of the sheet Sh1 set on the sheet placement table 21 in a lateral direction (in this case, the front-back direction D2) that is perpendicular to a longitudinal direction (conveyance direction) of the sheet Sh1.

One or more sheets Sh1, as a target of conveyance by the sheet conveying device 2, are set on the sheet placement table 21 in a state of being placed thereon. When a plurality of sheets Sh1 are set on the sheet placement table 21, the plurality of sheets Sh1 are placed on the sheet placement table 21 in a state of being overlaid in the up-down direction D1, namely, in a state of being stacked.

The sheet discharge table 22 is a member on which a sheet Sh1 that has been conveyed by the sheet conveying device 2 is placed. The sheet discharge table 22 is located below the sheet placement table 21. The sheet conveying device 2 conveys a sheet Sh1 placed on the sheet placement table 21 to pass the execution position P1 at which the image processing is executed by the image processing portion, and discharges the sheet Sh1 onto the sheet discharge table 22. In the present embodiment, since a sheet Sh1 conveyed by the sheet conveying device 2 is a sheet Sh1 (document sheet) as a target of image reading by the image reading portion 11, a sheet Sh1 from which an image has been read by the image reading portion 11 is discharged onto an upper surface of the sheet discharge table 22.

Here, as is the case with the sheet placement table 21, sheets Sh1 of various sizes (paper sizes) can be placed on the sheet discharge table 22. Furthermore, as is the case with the sheet placement table 21, when a plurality of sheets Sh1 are discharged onto the sheet discharge table 22, the plurality of sheets Sh1 are placed on the sheet discharge table 22 in a state of being overlaid in the up-down direction D1, namely, in a state of being stacked.

Figure 3:
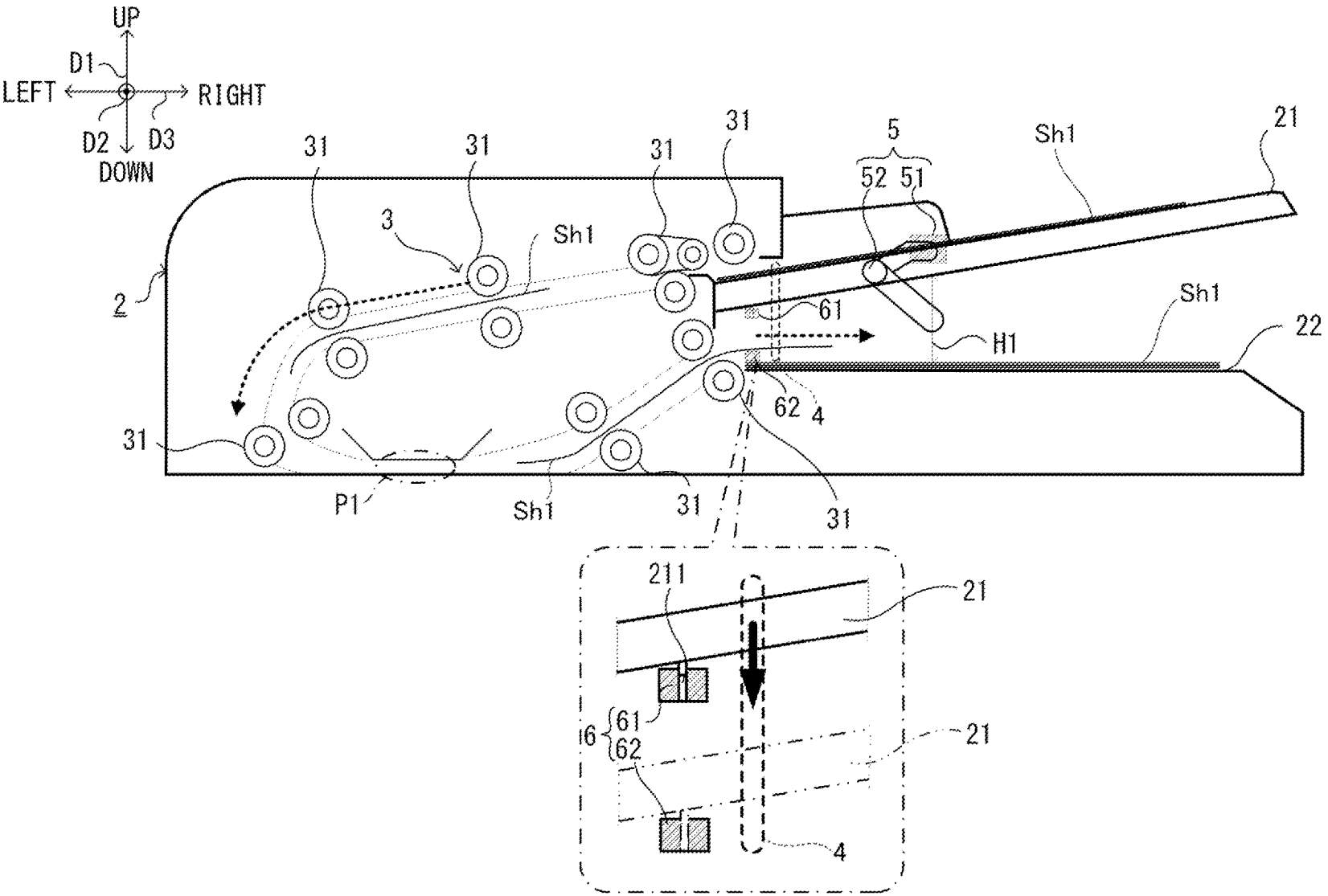
FIG. 3 is a schematic diagram showing an external appearance and an internal configuration of a sheet conveying device according to Embodiment 1.

As shown in FIG. 3, the conveyance mechanism 3 conveys a sheet Sh1 placed on the sheet placement table 21 onto the sheet discharge table 22 via the execution position P1. That is, the conveyance mechanism 3 conveys the sheet Sh1 from the sheet placement table 21 leftward and then downward as indicated by the dotted arrow in FIG. 3, turns back the sheet Sh1 to the right to pass through the execution position P1, and then discharges the sheet Sh1 onto the sheet discharge table 22. In other words, a conveyance path along which the sheet Sh1 is conveyed by the conveyance mechanism 3 includes the execution position P1 at which image processing (in the present embodiment, image reading) is executed by the image processing portion (in the present embodiment, the image reading portion 11).

For example, the conveyance mechanism 3 includes a plurality of conveyance rollers 31 and a power source. The conveyance mechanism 3 conveys sheets Sh1 set on the sheet placement table 21 one by one to the sheet discharge table 22 via the execution position P1 by driving the plurality of conveyance rollers 31, for example, by the power of the power source that includes a motor. For example, in a state where a predetermined number of sheets Sh1 are set on the sheet placement table 21, the conveyance mechanism 3 conveys the predetermined number of sheets Sh1 one by one until all of the predetermined number of sheets Sh1 are discharged onto the sheet discharge table 22. This allows the predetermined number of sheets Sh1 as a job target to be moved from on the sheet placement table 21 onto the sheet discharge table 22 that is located below the sheet placement table 21.

The raising/lowering mechanism 4 is configured to raise and lower the sheet placement table 21. That is, the sheet placement table 21 is configured to be moved in the up-down direction D1 at least within a predetermined raising/lowering range. Specifically, the raising/lowering mechanism 4 is configured to switchably execute a raising operation and a lowering operation, wherein with the raising operation, the raising/lowering mechanism 4 moves up the sheet placement table 21 relative to the housing 100, and with the lowering operation, the raising/lowering mechanism 4 moves down the sheet placement table 21 relative to the housing 100. Furthermore, in a state of executing neither the raising operation nor the lowering operation, the raising/lowering mechanism 4 supports the sheet placement table 21 at an arbitrary position within the raising/lowering range.

In the present embodiment, the raising/lowering mechanism 4 is configured to move the sheet placement table 21 in a stepless manner in the up-down direction D1 between an upper limit position (top dead center) and a lower limit position (bottom dead center) of the raising/lowering range, and stop the sheet placement table 21 at an arbitrary position in the raising/lowering range. As a result, when the raising/lowering mechanism 4 performs a raising operation, it is possible to move the sheet placement table 21 from the initial position to an arbitrary position between the initial position and the upper limit position of the raising/lowering range. Conversely, when the raising/lowering mechanism 4 performs a lowering operation, it is possible to move the sheet placement table 21 from the initial position to an arbitrary position between the initial position and the lower limit position of the raising/lowering range.

Specifically, the raising/lowering mechanism 4 includes, for example: a mechanism portion such as a ball screw, a rack-pinion, and a pantograph; and a power source. The raising/lowering mechanism 4 moves the sheet placement table 21 straight along the up-down direction D1 by driving the mechanism portion, for example, by the power of the power source that includes a motor. Here, the raising/lowering mechanism 4 preferably has a function to detect the current position of the sheet placement table 21 by including a sensor, such as an encoder, in the mechanism portion or in the power source. This allows the raising/lowering mechanism 4 to raise and lower the sheet placement table 21 only within the raising/lowering range, and return it to the initial position. Furthermore, the raising/lowering mechanism 4 preferably has a function to detect a load applied to the output of the power source. With such a function, the raising/lowering mechanism 4 can stop or reversely move the sheet placement table 21 when, for example, a foreign matter (for example, a part of the body of a user) is caught during raising or lowering of the sheet placement table 21, and an overload acts.

It noted here that the raising/lowering mechanism 4 only needs to have a function to raise and lower the sheet placement table 21, and the above-described detailed configurations of the raising/lowering mechanism 4 are optional to the sheet conveying device 2. For example, moving the sheet placement table 21 in a stepless manner is not indispensable, but the sheet placement table 21 may be moved in a stepwise manner. In addition, an initial position may be defined within the raising/lowering range, and, for example, the raising/lowering mechanism 4 may return the sheet placement table 21 to the initial position when the image processing (here, the image reading) is completed. Furthermore, not limited to the configuration to move the sheet placement table 21 straight along the up-down direction D1, the raising/lowering mechanism 4 may, for example, raise and lower the sheet placement table 21 by rotating the sheet placement table 21 with an end (left end) of the sheet placement table 21 in the left-right direction D3 as a fulcrum.

The clearance detection portion 5 detects a clearance H1 (see FIG. 3) that is generated above the sheet discharge table 22 and below the sheet placement table 21. The clearance H1 mentioned here is a gap (clearance), namely, a space generated between the sheet discharge table 22 and the sheet placement table 21 in the up-down direction D1, and is defined by a height from the sheet Sh1 on the sheet discharge table 22 to the sheet placement table 21. That is, in a state where there are some sheets Sh1 on the sheet discharge table 22, the clearance H1 is a space generated between the upper surface of the sheets Sh1 and the lower surface of the sheet placement table 21. Accordingly, a size of the clearance H1 (dimension in the up-down direction D1) corresponds to a distance between the upper surface of the sheets Sh1 and the lower surface of the sheet placement table 21. In addition, in a state where there is no sheet Sh1 on the sheet discharge table 22, the clearance H1 is a space generated between the upper surface of the sheet discharge table 22 and the lower surface of the sheet placement table 21. As a result, the larger the number of sheets Sh1 discharged onto the sheet discharge table 22 is, and for the same number of sheets Sh1, the larger the thickness of each sheet Sh1 is, the higher the upper surface of the sheets Sh1 is, and the smaller the clearance H1 is, when the sheet placement table 21 is located at the same position.

Figure 4:
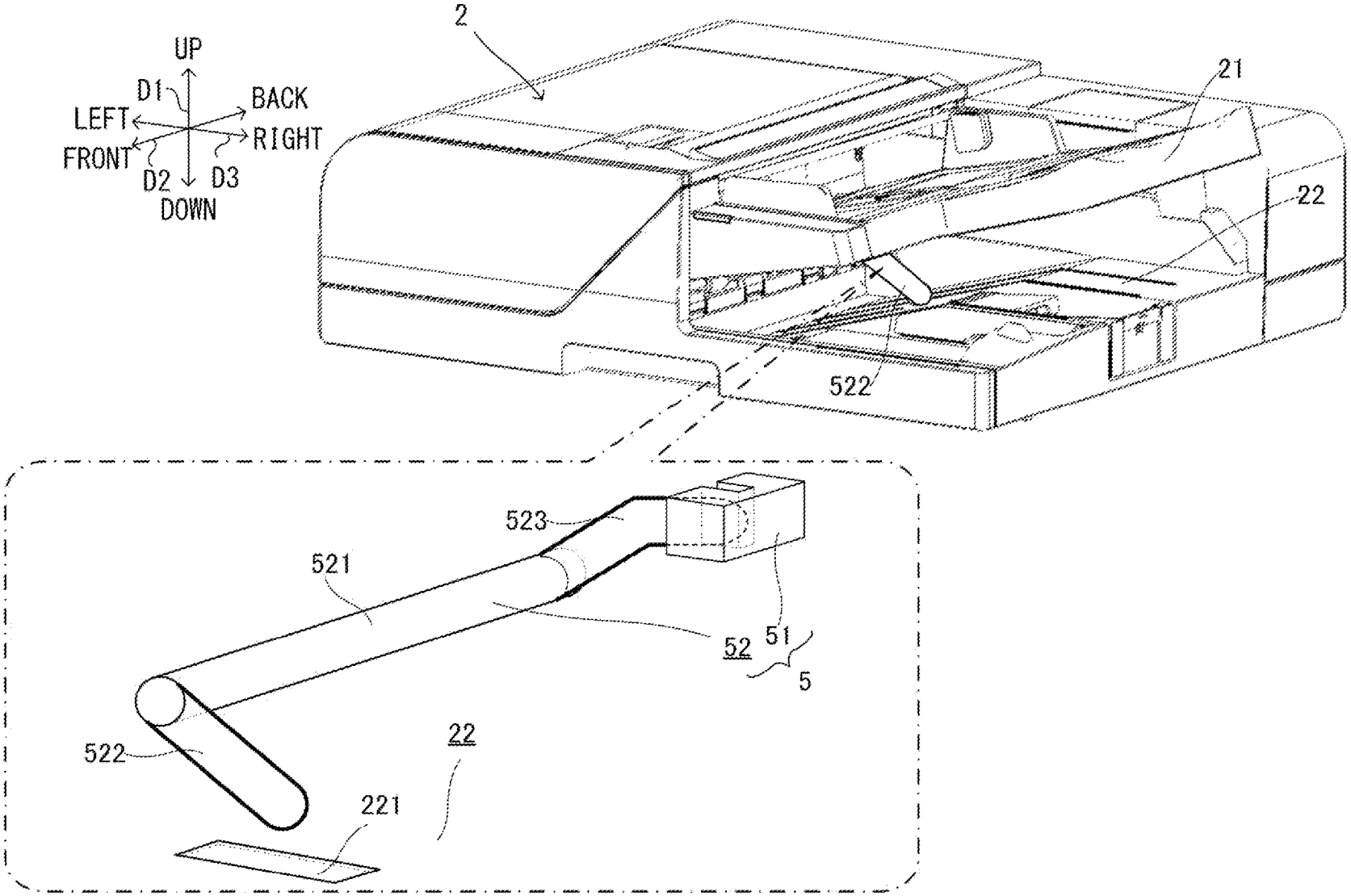
FIG. 4 is a schematic perspective diagram showing an external appearance of the sheet conveying device according to Embodiment 1, and a schematic perspective diagram of a clearance detection portion.
Figure 5:
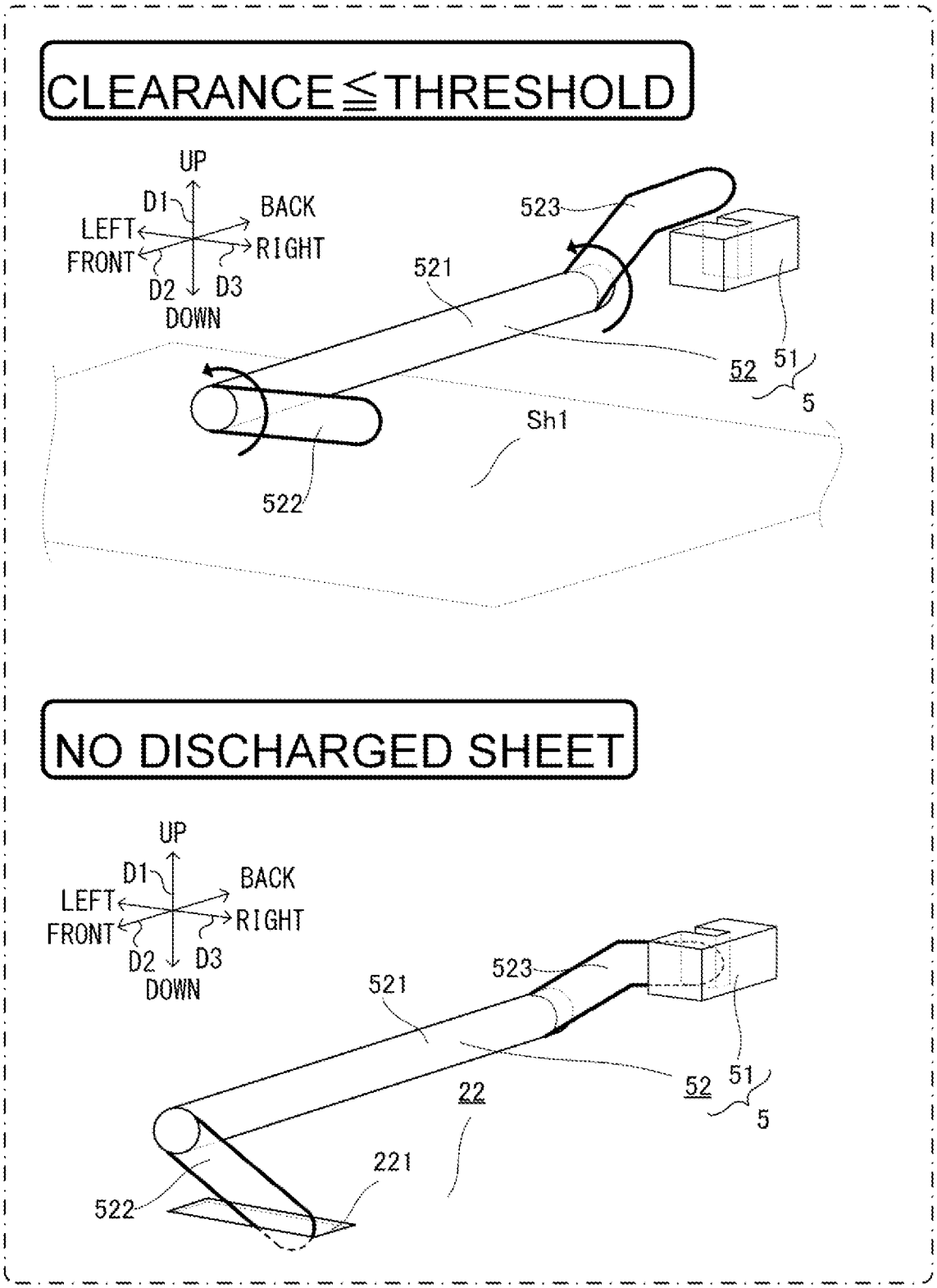
FIG. 5 is a schematic diagram showing an example of operation of the clearance detection portion of the sheet conveying device according to Embodiment 1.

In the present embodiment, as one example, the clearance detection portion 5 includes a sheet sensor 51 and a moving member 52. The sheet sensor 51 and the moving member 52 are held by the sheet placement table 21. As shown in FIG. 4, the moving member 52 includes a rotating shaft 521 extending in the front-rear direction D2, a contact piece 522, and a light shielding piece 523. The contact piece 522 and the light shielding piece 523 are provided at opposite ends of the rotating shaft 521 in the longitudinal direction in such a way as to protrude from the rotating shaft 521 in the radial direction. The moving member 52 is held by the sheet placement table 21 such that the contact piece 522 is located at a position that is above the sheet discharge table 22 and faces the center part of the sheet discharge table 22 in the front-rear direction D2. In addition, the moving member 52 is held by the sheet placement table 21 in such a manner that the contact piece 522 and the light shielding piece 523 can rotate around the rotating shaft 521. An escape hole 221 is formed at a part of the sheet discharge table 22 that faces the contact piece 522. As shown in FIG. 4, when no external force is applied to the contact piece 522, the moving member 52 is biased to a stand-by attitude in which the light shielding piece 523 is inserted in the sheet sensor 51.

In addition, the sheet sensor 51 is a light transmission type sensor including a light emitting element and a light receiving element, and the output of the sheet sensor 51 changes depending on whether or not the light receiving element has received light emitted from the light emitting element. In the present embodiment, as one example, the output of the sheet sensor 51 in a case where the light receiving element has received light emitted from the light emitting element, is defined as "ON", and the output of the sheet sensor 51 in a case where the light receiving element has not received light emitted from the light emitting element, is defined as "OFF". The clearance detection portion 5 outputs the output (electric signal) of the sheet sensor 51 to the control portion 15.

With the above-described configuration, when the moving member 52 is in the stand-by attitude, as shown in the balloon of FIG. 4, the light shielding piece 523 is inserted between the light emitting element and the light receiving element of the sheet sensor 51, the light from the light emitting element is shielded by the light shielding piece 523, and the output of the sheet sensor 51 is "OFF". On the other hand, as shown in the upper part of FIG. 5, when the clearance H1 is equal to or lower than a threshold that is described below, the sheet Sh1 on the sheet discharge table 22 comes to contact with the contact piece 522, causing the moving member 52 to be rotated, and the light shielding piece 523 is rotated. This causes the light shielding piece 523 to get out from between the light emitting element and the light receiving element of the sheet sensor 51, the light from the light emitting element reaches the light receiving element, and the output of the sheet sensor 51 becomes "ON". In addition, as shown in the lower part of FIG. 5, when there is no sheet Sh1 on the sheet discharge table 22, even when the sheet placement table 21 has moved down to the lower limit position of the raising/lowering range, the contact piece 522 is inserted in the escape hole 221, and the moving member 52 keeps the stand-by attitude. As a result, even in the state shown in the lower part of FIG. 5, the light shielding piece 523 is inserted between the light emitting element and the light receiving element of the sheet sensor 51, the light from the light emitting element is shielded by the light shielding piece 523, and the output of the sheet sensor 51 is "OFF".

The position detection portion 6 detects the sheet placement table 21 located at the upper limit position and the lower limit position of the raising/lowering range. That is, when the sheet placement table 21 is raised by the raising/lowering mechanism 4, the position detection portion 6 detects that the sheet placement table 21 has reached the upper limit position of the raising/lowering range. On the contrary, when the sheet placement table 21 is lowered by the raising/lowering mechanism 4, the position detection portion 6 detects that the sheet placement table 21 has reached the lower limit position of the raising/lowering range.

Specifically, as shown in FIG. 3, the position detection portion 6 includes an upper limit sensor 61 and a lower limit sensor 62. Each of the upper limit sensor 61 and the lower limit sensor 62 is a light transmission type sensor including a light emitting element and a light receiving element, and the output thereof changes depending on whether or not the light receiving element has received light emitted from the light emitting element. In the present embodiment, as one example, the output of the upper limit sensor 61 (or the lower limit sensor 62) in a case where the light receiving element has received light emitted from the light emitting element, is defined as "ON", and the output of the upper limit sensor 61 (or the lower limit sensor 62) in a case where the light receiving element has not received light emitted from the light emitting element, is defined as "OFF". The position detection portion 6 outputs the outputs (electric signals) of the upper limit sensor 61 and the lower limit sensor 62 to the control portion 15.

Here, the sheet placement table 21 includes a light shielding plate 211. Each of the upper limit sensor 61 and the lower limit sensor 62 detects the position of the sheet placement table 21 by detecting the position of the light shielding plate 211 that moves integrally with the sheet placement table 21. That is, as shown in the balloon of FIG. 3, when the sheet placement table 21 is located at the upper limit position of the raising/lowering range, the light shielding plate 211 is inserted between the light emitting element and the light receiving element of the upper limit sensor 61, the light from the light emitting element is shielded by the light shielding plate 211, and the output of the upper limit sensor 61 is "OFF". On the other hand, when the sheet placement table 21 is lowered to the lower limit position of the raising/lowering range, the light shielding plate 211 is inserted between the light emitting element and the light receiving element of the lower limit sensor 62, the light from the light emitting element is shielded by the light shielding plate 211, and the output of the lower limit sensor 62 is "OFF".

Meanwhile, there is known, as a technology related to the sheet conveying device 2 of this type, a sheet conveying device that includes a sheet placement table and a sheet discharge table, wherein a sheet is placed on the sheet placement table, and a sheet after image process is discharged to the sheet discharge table. The sheet conveying device of the related technology includes a conveyance mechanism that feeds sheets placed on the sheet placement table one by one to a reading position, and discharges a sheet after image processing (image reading) selectively onto one of two sheet discharge tables. In this sheet conveying device, the sheet placement table is located above the sheet discharge table. As a result, a sheet as a target of the image processing is moved from an upper side of the sheet placement table to a lower side thereof (between the sheet placement table and the sheet discharge table).

However, according to the configuration of the related technology, to deal with a large number of sheets, it is necessary to secure a space corresponding to the large number of sheets both at the upper side of the sheet placement table and at the lower side of the sheet placement table (between the sheet placement table and the sheet discharge table). This causes the device to occupy a large space in the up-down direction.

On the other hand, the present embodiment provides the sheet conveying device 2 and the image processing apparatus 10 that, with the configuration described in the following, restrict the device from occupying a large space in the up-down direction D1.

That is, the sheet conveying device 2 according to the present embodiment includes the sheet placement table 21, the sheet discharge table 22, the conveyance mechanism 3, the raising/lowering mechanism 4, and the raising/lowering control portion 23. The sheet discharge table 22 is located below the sheet placement table 21. The conveyance mechanism 3 conveys a sheet Sh1 placed on the sheet placement table 21 onto the sheet discharge table 22 via the execution position P1 at which the image processing is executed by the image processing portion. The raising/lowering mechanism 4 raises and lowers the sheet placement table 21. The raising/lowering control portion 23 controls the raising/lowering mechanism 4 in accordance with the clearance H1 that is defined by a height from the sheet Sh1 on the sheet discharge table 22 to the sheet placement table 21, so as to maintain the clearance H1 to be equal to or higher than a set value. In the present embodiment, the raising/lowering control portion 23 that is a component of the sheet conveying device 2 is provided in the control portion 15 as a function of the control portion 15.

With the above-described configuration, the sheet conveying device 2 according to the present embodiment and the image processing apparatus 10 including the sheet conveying device 2 have an advantage of being able to restrict the device from occupying a large space in the up-down direction D1. That is, the raising/lowering control portion 23 controls the raising/lowering mechanism 4 to raise and lower the sheet placement table 21 to maintain a height (clearance H1) from the sheet Sh1 on the sheet discharge table 22 to the sheet placement table 21, to be equal to or higher than a set value. For example, when image processing (for example, image reading) was executed on a large number of sheets Sh1, the clearance H1 would become gradually narrower as sheets Sh1 after image processing were sequentially discharged onto the sheet discharge table 22. In such a case, the raising/lowering control portion 23 controls the raising/lowering mechanism 4 to raise the sheet placement table 21 so that the clearance H1 is widened and the clearance H1 is maintained to be equal to or higher than the set value. This makes it possible to secure a space (clearance H1) at the lower side of the sheet placement table (between the sheet placement table and the sheet discharge table) in correspondence with the thickness of the large number of sheets Sh1 since it is possible to raise the sheet placement table 21 even when the initial position of the sheet placement table 21 is set to a low position. As a result, it is possible to restrict the device from occupying a large space in the up-down direction D1.

Here, when one or more sheets Sh1 are discharged onto the sheet discharge table 22, and the clearance H1 becomes equal to or lower than a threshold that is determined based on the set value, the raising/lowering control portion 23 raises the sheet placement table 21. The threshold mentioned here is a value that is set based on the set value so as to maintain the clearance H1 to be equal to or higher than the set value. For example, the threshold is a value that is obtained by adding a predetermined value to the set value. That is, the raising/lowering control portion 23 controls the raising/lowering mechanism 4 to raise the sheet placement table 21 based on the output of the clearance detection portion 5 (output of the sheet sensor 51). Here, the raising/lowering control portion 23 starts the control to raise the sheet placement table 21 when the size of the clearance H1 (dimension in the up-down direction D1) detected by the clearance detection portion 5 becomes equal to or lower than the threshold. Specifically, as described above, in the clearance detection portion 5, when the clearance H1 is equal to or lower than the threshold, the contact piece 522 is pressed by the sheet Sh1 on the sheet discharge table 22, causing the moving member 52 to be rotated, and the light shielding piece 523 gets out from between the light emitting element and the light receiving element of the sheet sensor 51. At this time, when the output of the sheet sensor 51 of the clearance detection portion 5 becomes "ON", the raising/lowering control portion 23 starts the control to raise the sheet placement table 21.

For example, in a case where the set value is 30 mm, the threshold is set to 40 mm that is obtained by adding a predetermined value (for example, 10 mm) to the set value. In this case, when one or more sheets Sh1 are discharged onto the sheet discharge table 22, the clearance H1 becomes gradually narrower, and the clearance H1 becomes equal to or higher than 40 mm that is the threshold, the output of the sheet sensor 51 of the clearance detection portion 5 becomes "ON". This causes the raising/lowering control portion 23 to control the raising/lowering mechanism 4 to raise the sheet placement table 21. At this time, the raising/lowering control portion 23 may raise the sheet placement table 21 by a predetermined amount (for example, 10 mm) or continue to raise the sheet placement table 21 for a predetermined time period (for example, one second). In this way, the raising/lowering control portion 23 starts to move up (raise) the sheet placement table 21 when the size of the clearance H1 (dimension in the up-down direction D1) detected by the clearance detection portion 5 becomes equal to or lower than the threshold (40 mm).

With the above-described configuration, the clearance H1 is maintained to be equal to or higher than the set value (for example, 30 mm) even when one or more sheets Sh1 are discharged onto the sheet discharge table 22 and the clearance H1 becomes gradually narrower. Accordingly, the clearance H1 that is sufficient for a sheet Sh1 to be further discharged is secured on the sheet discharge table 22, and conveyance of a sheet Sh1 can be continued. Furthermore, it is easy for the user to remove the sheet Sh1 from on the sheet discharge table 22 since the clearance H1 is secured and a hand of the user can easily reach the sheet Sh1.

In addition, at least during execution of the image processing on a predetermined number of sheets Sh1 that are the job target, the raising/lowering control portion 23 controls the raising/lowering mechanism 4 in accordance with the clearance H1 so as to maintain the clearance H1 to be equal to or higher than the set value. The "job target" mentioned here means a target of an image processing job. In the present embodiment, since the image processing executed on the sheet Sh1 is the image reading performed by the image reading portion 11, the raising/lowering control portion 23 controls the raising/lowering mechanism 4 so as to maintain the clearance H1 to be equal to or higher than the set value after an image reading job is started until the image reading is completed on all of the predetermined number of sheets Sh1 that are the job target.

For example, in a case where 10 (ten) sheets Sh1 have been set on the sheet placement table 21, it is determined that the image processing is completed on all of the predetermined number of sheets Sh1 that are the job target when all of the 10 sheets Sh1 are discharged onto the sheet discharge table 22. Accordingly, the raising/lowering control portion 23 controls the raising/lowering mechanism 4 to maintain the clearance H1 to be equal to or higher than the set value after the 1st sheet Sh1 of the 10 sheets Sh1 starts to be conveyed until the 10th sheet Sh1 of the 10 sheets Sh1 is discharged onto the sheet discharge table 22. Accordingly, at least during execution of a job (in this case, an image reading job), the clearance H1 that is sufficient for a sheet Sh1 to be further discharged, is secured above the sheet discharge table 22, and conveyance of a sheet Sh1 is continued.

Here, the raising/lowering mechanism 4 can raise and lower the sheet placement table 21 only within the raising/lowering range. Accordingly, when the raising/lowering control portion 23 raises the sheet placement table 21 and the sheet placement table 21 reaches the upper limit position of the upper limit position of the raising/lowering range, the sheet placement table 21 is not raised any higher. Specifically, the output of the upper limit sensor 61 of the position detection portion 6 becomes "OFF" when the sheet placement table 21 reaches the upper limit position of the raising/lowering range. As a result, when the output of the upper limit sensor 61 of the position detection portion 6 becomes "OFF" during a control to raise the sheet placement table 21, the raising/lowering control portion 23 stops the raising operation of the raising/lowering mechanism 4. With this configuration, the sheet placement table 21 stops at the upper limit position of the raising/lowering range even if the clearance H1 becomes lower than the set value. Similarly, the output of the lower limit sensor 62 of the position detection portion 6 becomes "OFF" when the sheet placement table 21 reaches the lower limit position of the raising/lowering range. As a result, when the output of the lower limit sensor 62 of the position detection portion 6 becomes "OFF" during a control to lower the sheet placement table 21, the raising/lowering control portion 23 stops the lowering operation of the raising/lowering mechanism 4. With this configuration, the sheet placement table 21 stops at the lower limit position of the raising/lowering range.

Figure 6:
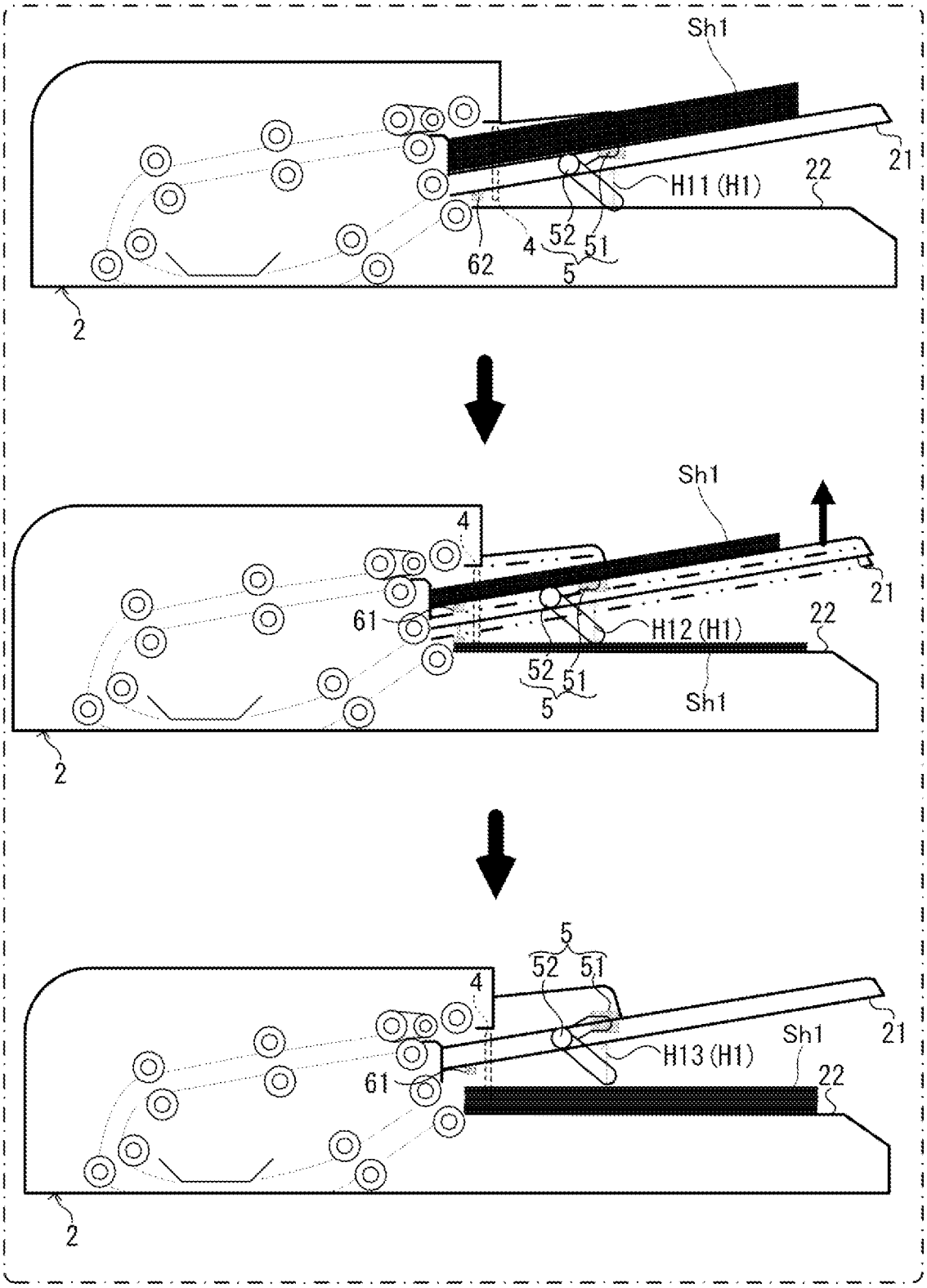
FIG. 6 is a schematic diagram showing an example of raising/lowering operation of the sheet placement table in a normal mode of the sheet conveying device according to Embodiment 1.

With the above-described configuration, as shown in FIG. 6 for example, the raising/lowering control portion 23 raises the sheet placement table 21 as sheets Sh1 are sequentially conveyed. FIG. 6 shows a case where the sheet placement table 21 is gradually raised from the lower limit position of the raising/lowering range. That is, as shown in the upper part of FIG. 6, when all of the predetermined number of sheets Sh1 that are the job target are placed on the sheet placement table 21, no sheet Sh1 is present on the sheet discharge table 22. In this state, the contact piece 522 is inserted in the escape hole 221, the moving member 52 maintains the stand-by attitude, and the output of the sheet sensor 51 of the clearance detection portion 5 is "OFF". At this time, a clearance H11 is lower than the set value.

On the other hand, when a job (image reading job) is started, one or more sheets Sh1 are conveyed from the sheet placement table 21 onto the sheet discharge table 22, and the one or more sheets Sh1 come to be present on the sheet discharge table 22. In this state, the contact piece 522 is pressed by the sheets Sh1 on the sheet discharge table 22, causing the moving member 52 to be rotated, and the output of the sheet sensor 51 of the clearance detection portion 5 becomes "ON". At this time, as shown in the middle part of FIG. 6, the raising/lowering control portion 23 controls the raising/lowering mechanism 4 to move up (raise) the sheet placement table 21. As a result, a clearance H12 is maintained to be equal to or higher than the set value (H12>H11).

As the job (image reading job) continues, one or more sheets Sh1 are further conveyed from the sheet placement table 21 onto the sheet discharge table 22, and the number of sheets Sh1 on the sheet discharge table 22 increases. As a result, the contact piece 522 is pressed by the sheets Sh1 on the sheet discharge table 22, causing the moving member 52 to be rotated, and the output of the sheet sensor 51 of the clearance detection portion 5 is "ON". At this time, the raising/lowering control portion 23 controls the raising/lowering mechanism 4 to further move up (raise) the sheet placement table 21. As a result, as shown in the lower part of FIG. 6, even when all of the predetermined number of sheets Sh1 that are the job target have been discharged onto the sheet discharge table 22, a clearance H13 is maintained to be equal to or higher than the set value (H13=H12).

It noted here that the raising/lowering control portion 23 only needs to be configured to control the raising/lowering mechanism 4 based on an output (detection result) of the clearance detection portion 5, and it is not indispensable that the clearance detection portion 5 is included in the sheet conveying device 2 as a component thereof. For example, the raising/lowering control portion 23 may control the raising/lowering mechanism 4 based on an output of the clearance detection portion 5 that is an external device provided independent of the sheet conveying device 2.

In addition, in the present embodiment, the raising/lowering control portion 23 controls the raising/lowering mechanism 4 to lower the sheet placement table 21 upon completion of the image processing on all of the predetermined number of sheets Sh1 that are the job target. Here, completion of the image processing on all of the predetermined number of sheets Sh1 that are the job target corresponds to completion of a job (for example, an image reading job). That is, in the present embodiment, during execution of a job, the raising/lowering control portion 23 operates in a normal mode to control the raising/lowering mechanism 4 to maintain the clearance H1 to be equal to or higher than the set value, and after the job is completed, the raising/lowering control portion 23 operates in a lowering mode to control the raising/lowering mechanism 4 to lower the sheet placement table 21. In this way, the raising/lowering control portion 23 is configured to switch among a plurality of modes that include at least the normal mode and the lowering mode. With this configuration, it is possible to set a large number of sheets Sh1 on the sheet placement table 21 since, after a job is completed, the sheet placement table 21 is located at a low position in preparation for another job.

It is noted here that after a job is completed, the user removes, namely, takes out the sheet Sh1 on which the image processing (here, the image reading) has been performed, from on the sheet discharge table 22. As a result, it is preferable that the sheet placement table 21 does not start to move down before the sheet Sh1 is taken out. Specifically, the raising/lowering control portion 23 does not immediately start to lower the sheet placement table 21 after a job is completed, but starts to lower the sheet placement table 21 after a predetermined stand-by time (for example, one minute) passes. This facilitates for the user to remove the discharged sheet Sh1 during the stand-by time for which a sufficient clearance H1 is secured.

The determination on whether or not the image processing is completed on all of the predetermined number of sheets Sh1 that are the job target, may be made based on the operation state of the image processing portion (here, the image reading portion 11), or may be made in other ways. For example, when all sheets Sh1 have gone from on the sheet placement table 21, or when all sheets Sh1 have been discharged onto the sheet discharge table 22, it may be determined that the image processing is completed on all of the predetermined number of sheets Sh1 that are the job target.

In addition, in the present embodiment, the clearance detection portion 5 that is configured to detect the clearance H1 is used to detect whether or not a sheet Sh1 is present on the sheet discharge table 22. Specifically, in the lowering mode in which the raising/lowering control portion 23 lowers the sheet placement table 21, the output of the clearance detection portion 5 is used to detect whether or not a sheet Sh1 is present on the sheet discharge table 22. In short, in the present embodiment, the output of the clearance detection portion 5 is used both to detect the clearance H1 in the normal mode, and to detect whether or not a sheet Sh1 is present in the lowering mode. With this configuration, it is possible to detect whether or not a sheet Sh1 is present on the sheet discharge table 22, without providing a detection means other than the clearance detection portion 5.

More specifically, in the clearance detection portion 5, the output of the sheet sensor 51 becomes "ON" when a sheet Sh1 is present on the sheet discharge table 22. For example, if the user removes all sheets Sh1 on which the image processing (here, the image reading) has been performed, from on the sheet discharge table 22 after a job is completed, there will be no sheet Sh1 on the sheet discharge table 22. In this case, when the raising/lowering control portion 23 lowers the sheet placement table 21 in the lowering mode and the sheet placement table 21 moves down to the lower limit position of the raising/lowering range, the contact piece 522 of the clearance detection portion 5 is inserted in the escape hole 221, and the output of the sheet sensor 51 does not become "ON". As a result, in this case, the sheet placement table 21 moves down to the lower limit position of the raising/lowering range while the output of the sheet sensor 51 of the clearance detection portion 5 is "OFF", and the sheet placement table 21 stops when the output of the lower limit sensor 62 of the position detection portion 6 becomes "OFF".

On the other hand, in a case where a sheet Sh1 is present on the sheet discharge table 22, when the raising/lowering control portion 23 lowers the sheet placement table 21 in the lowering mode, the output of the sheet sensor 51 of the clearance detection portion 5 becomes "ON" before the sheet placement table 21 moves down to the lower limit position of the raising/lowering range. That is, the contact piece 522 of the clearance detection portion 5 comes to contact with the sheet Sh1 on the sheet discharge table 22, the moving member 52 is rotated, and the output of the sheet sensor 51 becomes "ON". Accordingly, in this case, when the output of the sheet sensor 51 of the clearance detection portion 5 becomes "ON", it is detected that the sheet Sh1 is present on the sheet discharge table 22.

When the clearance detection portion 5 detects presence of the sheet Sh1 on the sheet discharge table 22 while the raising/lowering control portion 23 operates in the lowering mode, the raising/lowering control portion 23 stops lowering the sheet placement table 21. Furthermore, in this case, it is assumed that the user has forgotten to remove the sheet Sh1 on which the image processing (here, the image reading) had been performed, from on the sheet discharge table 22, and it is preferable to notify the user of the fact.

In the present embodiment, the notification control portion 24 notifies the user of the fact that a sheet Sh1 is present on the sheet discharge table 22, namely, that the user has forgotten to remove the sheet Sh1 from on the sheet discharge table 22. Specifically, the notification control portion 24 performs the notification by a display on the operation/display portion 14, by changing the lighting state of an LED for display, by emitting a notification sound, or by a combination of these. The trigger for the raising/lowering control portion 23 to perform the notification is not limited to when the clearance detection portion 5 detects presence of a sheet Sh1 on the sheet discharge table 22 while the raising/lowering control portion 23 operates in the lowering mode, but may be, for example, when an operation is performed to newly start the image processing (image reading) while presence of a sheet Sh1 on the sheet discharge table 22 is detected.

After the clearance detection portion 5 detects a sheet Sh1 on the sheet discharge table 22, when the sheet Sh1 is removed and the clearance detection portion 5 no longer detects a sheet Sh1 on the sheet discharge table 22, the notification control portion 24 stops the notification. Furthermore, when the clearance detection portion 5 no longer detects a sheet Sh1 on the sheet discharge table 22, the raising/lowering control portion 23 preferably resumes lowering the sheet placement table 21.

[3] Sheet Conveying Method

Figure 7:
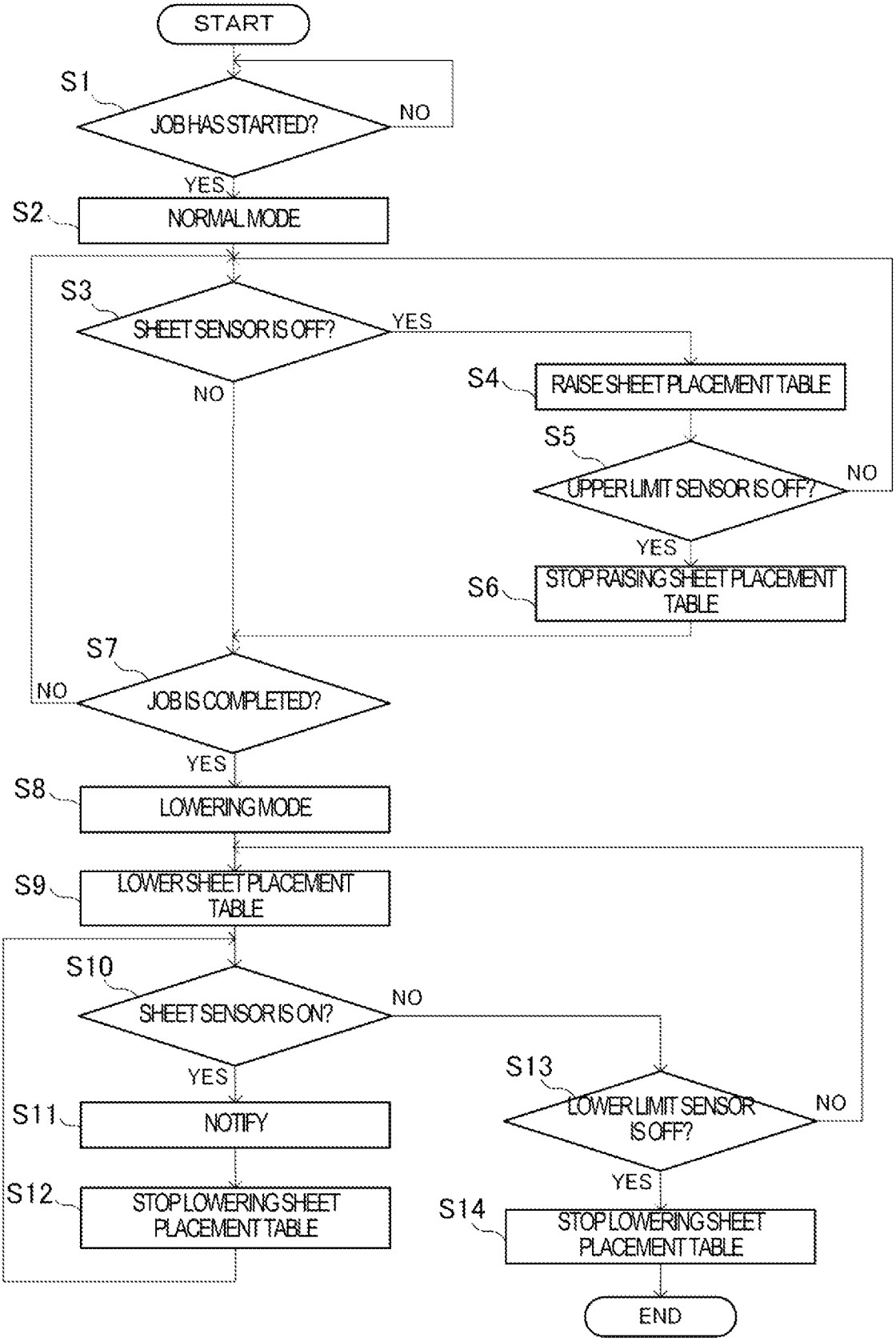
FIG. 7 is a flowchart showing an example of operation of the sheet conveying device according to Embodiment 1.

Next, with reference to FIG. 7, the sheet conveying method according to the present embodiment, namely, an operation of the sheet conveying device 2, is described. Here, steps S1, S2, . . . in the flowchart shown in FIG. 7 represent numbers assigned to the processing procedures (steps) executed by the control portion 15 (mainly the raising/lowering control portion 23 and the notification control portion 24). The main configuration of the control portion 15 is a computer system that includes one or more processors and one or more memories. As a result, the following process is realized when the one or more processors execute a conveyance control program.

<Step S1>

First, in step S1, the raising/lowering control portion 23 determines whether or not a job has started. That is, since the raising/lowering control portion 23 starts to control the raising/lowering mechanism 4 in the normal mode when a job has started, the raising/lowering control portion 23 first determines whether or not a job has started. When conveyance of the $1^{st}$ sheet Sh1 of a predetermined number of sheets Sh1 that are the job target has started, the raising/lowering control portion 23 determines that the job has started (S1: Yes), and moves the process to step S2. On the other hand, when no operation to start the job has not been performed, the raising/lowering control portion 23 determines that the job has not started (S1: No), and repeatedly executes step S1.

<Steps S2, S3>

In step S2, the raising/lowering control portion 23 sets the operation mode to the normal mode. Subsequently, in step S3, the raising/lowering control portion 23 determines whether or not the output of the sheet sensor 51 of the clearance detection portion 5 is "OFF". When there is no sheet Sh1 on the sheet discharge table 22, or when the clearance H1 is higher than the threshold, the raising/lowering control portion 23 determines that the output of the sheet sensor 51 is "OFF" (S3: Yes), and moves the process to step S4. On the other hand, when there are one or more sheets Sh1 on the sheet discharge table 22 and the clearance H1 is equal to or lower than the threshold, the raising/lowering control portion 23 determines that the output of the sheet sensor 51 is "ON" (S3: No), and moves the process to step S7.

<Steps S4, S5, S6>

In step S4, the raising/lowering control portion 23 causes the raising/lowering mechanism 4 to perform the raising operation to move up (raise) the sheet placement table 21. At this time, the raising/lowering control portion 23 may raise the sheet placement table 21 by a predetermined amount (for example, 10 mm), continue to raise the sheet placement table 21 for a predetermined time period (for example, one second), or continuously raise the sheet placement table 21. In step S5, the raising/lowering control portion 23 determines whether or not the output of the upper limit sensor 61 of the position detection portion 6 is "OFF". When the sheet placement table 21 has already reached the upper limit position of the raising/lowering range, the raising/lowering control portion 23 determines that the output of the upper limit sensor 61 is "OFF" (S5: Yes), and moves the process to step S6. On the other hand, when the sheet placement table 21 has not reached the upper limit position of the raising/lowering range, the raising/lowering control portion 23 determines that the output of the upper limit sensor 61 is "ON" (S5: No), and moves the process to step S3. In step S6, the raising/lowering control portion 23 stops raising the sheet placement table 21, and moves the process to step S7.

<Steps S7>

In step S7, the raising/lowering control portion 23 determines whether or not the job is completed. That is, the raising/lowering control portion 23 ends the control in the normal mode when the job is completed, and changes the operation mode to the lowering mode. When the image processing is completed on all of the predetermined number of sheets Sh1 that are the job target, the raising/lowering control portion 23 determines that the job is completed (S7: Yes), and moves the process to step S8. On the other hand, when the image processing is not completed on all of the predetermined number of sheets Sh1 that are the job target, the raising/lowering control portion 23 determines that the job is not completed (S7: No), and moves the process to step S3.

<Steps S8, S9>

In step S8, the raising/lowering control portion 23 sets the operation mode to the lowering mode. Subsequently, in step S9, the raising/lowering control portion 23 causes the raising/lowering mechanism 4 to perform the lowering operation to move down (lower) the sheet placement table 21. At this time, the raising/lowering control portion 23 may lower the sheet placement table 21 by a predetermined amount (for example, 10 mm), continue to lower the sheet placement table 21 for a predetermined time period (for example, one second), or continuously lower the sheet placement table 21.

<Steps S10, S11, S12>

In step S10, the raising/lowering control portion 23 determines whether or not the output of the sheet sensor 51 of the clearance detection portion 5 is "ON". When there is a sheet Sh1 on the sheet discharge table 22, the raising/lowering control portion 23 determines that the output of the sheet sensor 51 is "ON" (S10: Yes), and moves the process to step S11. On the other hand, when there is no sheet Sh1 on the sheet discharge table 22, the raising/lowering control portion 23 determines that the output of the sheet sensor 51 is "OFF" (S10: No), and moves the process to step S13. In step S11, the notification control portion 24 notifies the user of the fact that a sheet Sh1 is present on the sheet discharge table 22, namely, that the user has forgotten to remove the sheet Sh1 from on the sheet discharge table 22. In step S12, the raising/lowering control portion 23 stops lowering the sheet placement table 21, and moves the process to step S10.

<Steps S13, S14>

In step S13, the raising/lowering control portion 23 determines whether or not the output of the lower limit sensor 62 of the position detection portion 6 is "OFF". When the sheet placement table 21 has already reached the lower limit position of the raising/lowering range, the raising/lowering control portion 23 determines that the output of the upper limit sensor 61 is "OFF" (S13: Yes), and moves the process to step S14. On the other hand, when the sheet placement table 21 has not reached the lower limit position of the raising/lowering range, the raising/lowering control portion 23 determines that the output of the upper limit sensor 61 is "ON" (S13: No), and moves the process to step S9. In step S14, the raising/lowering control portion 23 stops lowering the sheet placement table 21, and ends the series of processes.

The above-described procedure of the sheet conveying method is only an example, and the order of the processes included in the flowchart of FIG. 7 may be appropriately changed, or some processes may be added to the flowchart.

[4] Modification

A plurality of components of the image processing apparatus 10 may be provided dispersedly in a plurality of housings. For example, the raising/lowering control portion 23 that is a component of the sheet conveying device 2 may not necessarily be realized as a function of the control portion 15, but may be provided in a housing that is different from a housing of the control portion 15. That is, the sheet conveying device 2 may not be integrated with the image processing apparatus 10, but at least a part of the sheet conveying device 2 may be provided in a housing that is different from a housing of the image processing apparatus 10.

In addition, the sheet conveyed by the sheet conveying device 2 may be the sheet Sh2 as a target of image forming by the image forming portion 12, namely, a sheet supplied by the sheet feed portion 13. In this case, for example, a manual feed tray of the sheet feed portion 13 corresponds to the sheet placement table of the sheet conveying device 2, and the sheet discharge tray 123 of the image forming portion 12 corresponds to the sheet discharge table of the sheet conveying device 2.

In addition, the set value for the clearance H1 may be arbitrarily set based on a user operation.

In addition, the arrangement, the detection method and the like of the sheet sensor 51 of the clearance detection portion 5 and the upper limit sensor 61 and the lower limit sensor 62 of the position detection portion 6 are not limited to those described in Embodiment 1, but may be changed appropriately. For example, the upper limit sensor 61 and the lower limit sensor 62 may be, for example, reflection type sensors that use reflection of light or ultrasonic waves.

In addition, the raising/lowering control portion 23 is not limited to the configuration to raise the sheet placement table 21 when one or more sheets Sh1 are discharged onto the sheet discharge table 22 and the clearance H1 becomes equal to or lower than a threshold that is determined based on the set value. For example, the raising/lowering control portion 23 may raise the sheet placement table 21 based on the number and the thickness of sheets Sh1 discharged onto the sheet discharge table 22, without being based on the clearance H1. In addition, it is not indispensable that the raising/lowering control portion 23, at least during execution of the image processing on a predetermined number of sheets Sh1 that are the job target, controls the raising/lowering mechanism 4 in accordance with the clearance H1 so as to maintain the clearance H1 to be equal to or higher than the set value. For example, during execution of the image processing on a predetermined number of sheets Sh1 that are the job target, the raising/lowering control portion 23 may switch between maintaining and not maintaining the clearance H1 to be equal to or higher than the set value.

In addition, the raising/lowering control portion 23 is not limited to the configuration to control the raising/lowering mechanism 4 to lower the sheet placement table 21 upon completion of the image processing on all of the predetermined number of sheets Sh1 that are the job target. For example, the raising/lowering control portion 23 may hold the sheet placement table 21 to a position at which it is located when the job is completed. In addition, it is not indispensable that the clearance detection portion 5 configured to detect the clearance H1 is used to detect whether or not there is a sheet Sh1 on the sheet discharge table 22. For example, a means for detecting whether or not there is a sheet Sh1 on the sheet discharge table 22 may be provided independent of the clearance detection portion 5.

Embodiment 2

The image processing apparatus 10 according to the present embodiment differs from the image processing apparatus 10 according to Embodiment 1 in the configuration of the clearance detection portion 5. In the following description, the same components as those in Embodiment 1 are assigned the same reference signs, and description thereof is omitted as necessary.

In the present embodiment, the clearance detection portion 5 is a ranging sensor that is configured to measure a height (clearance H1) from the sheet Sh1 on the sheet discharge table 22 to the sheet placement table 21. For example, the ranging sensor is disposed on the lower surface side of the sheet placement table 21, and measures the height from an upper surface of the sheet Sh1 discharged on the sheet discharge table 22 to a lower surface of the sheet placement table 21. The ranging sensor is, for example, a contactless sensor that uses reflection of light or ultrasonic waves.

In a modification of Embodiment 2, the clearance detection portion 5 may estimate a total thickness of sheets Sh1 on the sheet discharge table 22 based on: the number of sheets Sh1 on which the image processing is executed; and the thickness of each sheet Sh1, and may detect the clearance H1 from a difference between the absolute position of the sheet placement table 21 and the total thickness. The configuration (including the modification) of Embodiment 2 is applicable in combination with the configuration (including the modification) of Embodiment 1.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a sheet placement table;

a sheet discharge table located below the sheet placement table;

a conveyance mechanism configured to convey a sheet placed on the sheet placement table onto the sheet discharge table via an execution position at which image processing is executed by an image processing portion;

a raising/lowering mechanism configured to raise and lower the sheet placement table;

a clearance detection portion configured to detect a clearance that is defined by a height from the sheet on the sheet discharge table to the sheet placement table; and a raising/lowering control portion configured to control the raising/lowering mechanism in accordance with the clearance, so as to maintain the clearance to be equal to or higher than a set value.

2. The sheet conveying device according to claim 1, wherein when one or more sheets are discharged onto the sheet discharge table and the clearance becomes equal to or lower than a threshold that is determined based on the set value, the raising/lowering control portion raises the sheet placement table.

3. The sheet conveying device according to claim 1, wherein at least during execution of the image processing on a predetermined number of sheets that are a job target, the raising/lowering control portion controls the raising/lowering mechanism in accordance with the clearance so as to maintain the clearance to be equal to or higher than the set value.

4. The sheet conveying device according to claim 3, wherein the raising/lowering control portion controls the raising/lowering mechanism to lower the sheet placement table upon completion of the image processing on all of the predetermined number of sheets that are the job target.

5. The sheet conveying device according to claim 1, wherein the execution position is a position where an image reading portion as the image processing portion executes image reading.

6. An image processing apparatus comprising:

the sheet conveying device according to claim 1; and the image processing portion configured to execute at least one of image reading and image forming on the sheet as a target.

7. A sheet conveying method used in a sheet conveying device that includes:

a sheet placement table;

a sheet discharge table located below the sheet placement table;

a conveyance mechanism configured to convey a sheet placed on the sheet placement table onto the sheet discharge table via an execution position at which image processing is executed by an image processing portion;

a raising/lowering mechanism configured to raise and lower the sheet placement table; and a clearance detection portion configured to detect a clearance that is defined by a height from the sheet on the sheet discharge table to the sheet placement table, the sheet conveying method comprising controlling the raising/lowering mechanism in accordance with the clearance, so as to maintain the clearance to be equal to or higher than a set value.

* * * * *